United States Patent [19]

Ferguson

[11] 4,295,314

[45] Oct. 20, 1981

[54] SHOULDERED SHAKE AND FILLER ROOF STRUCTURE

[76] Inventor: Stewart Ferguson, P.O. Box 12, Aloha, Wash. 98525

[21] Appl. No.: 59,998

[22] Filed: Jul. 23, 1979

[51] Int. Cl.[3] ..... E04D 1/00

[52] U.S. Cl. ..... 52/553; 52/560

[58] Field of Search ..... 52/518, 535, 541, 553, 52/533, 560, 543, 549, 527, 551

[56] References Cited

U.S. PATENT DOCUMENTS

| | | | |
|---|---|---|---|
| 1,887 | 12/1840 | Docker | 52/543 X |
| 1,924,650 | 8/1933 | Payne | 52/560 X |
| 2,138,663 | 11/1938 | Miles | 52/518 |
| 3,440,777 | 4/1969 | Martin | 52/551 X |
| 3,720,031 | 3/1973 | Wilson et al. | 52/560 X |

*Primary Examiner*—Carl D. Friedman

*Attorney, Agent, or Firm*—Ward Brown; Douglas W. Winters; Robert W. Beach

[57] ABSTRACT

The longitudinal sides of rectangular wood roofing shakes are stepped providing transversely extending shoulders facing the shake tips and dividing each shake into a narrower tip portion and a wider butt portion. In application, rectangular fillers are located between the tip portions of adjacent shakes with the butts of such fillers tightly abutting the shake shoulders. The width of each filler is substantially greater than the combined depths of the shake shoulders it abuts such that the adjacent longitudinal sides of the butt portions of the shakes are spaced apart a substantial distance.

16 Claims, 5 Drawing Figures

SHOULDERED SHAKE AND FILLER ROOF STRUCTURE

BACKGROUND OF THE INVENTION

1. Field of the Invention

The present invention relates to sloping roofs of the type having horizontal rows of individual wooden covering elements applied in overlapping courses.

2. Prior Art

It is known to apply generally rectangular split or resawn wood shakes in overlapping courses to form the roof of a building structure. The adjacent sides of adjacent shakes in a course are always spaced apart slightly to enable expansion of the shakes transversely of the grain resulting from changes in moisture content and/or temperature without buckling. Strips of building felt may be applied covering the tip portions of the shakes of each course. Nevertheless, rain or snow may be blown upward through the spaces between adjacent shakes and beneath the felt strips, which results in leaks. In addition, in case of a roof fire, air circulates readily between the shakes increasing the rate at which the fire spreads.

SUMMARY OF THE INVENTION

It is an object of the present invention to provide a roof structure of the type including split or resawn wood shakes applied in overlapping courses, in which the adjacent sides of the exposed portions of adjacent shakes may be spaced apart without increasing the tendency of the roof structure to leak and without increasing the rate at which fire would spread should a fire occur.

It also is an object to provide such a roof structure using component parts that are easy to manufacture, formed from readily available building elements and easy to apply.

The foregoing objects can be accomplished by providing a roof structure including wood shakes each having stepped sides forming transversely extending shoulders facing the tip end of the shake and dividing the shake into a narrower tip portion and a wider butt portion, and rectangular plugs or fillers fitted between the adjacent tip portions of adjacent shakes. The butts of the plugs abut the shoulders of adjacent shakes.

In the preferred embodiment of the invention, the width of each plug preferably is substantially greater than the combined depths of the shoulders against which its butt bears, such that the adjacent sides of the butt portions of adjacent shakes are spaced apart a substantial distance. The tips and shoulders of shakes in each course, and the plugs of such course, are overlapped by the butt portions of the shakes in the next higher course of shakes so that only the spaced shake butt portions are directly exposed to the weather.

DETAILED DESCRIPTION

Figure 1:
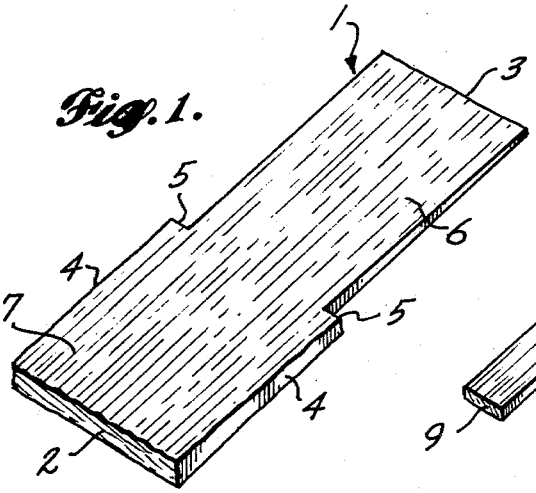
FIG. 1 and FIG. 2 are top perspectives of the component parts of a roof structure in accordance with the present invention, FIG. 1 showing an individual generally rectangular covering element, such as a shake, constructed in accordance with the invention, and FIG. 2 showing a plug or filler in accordance with the invention.

As shown in FIG. 1, one component part of a roof structure in accordance with the present invention is a generally rectangular individual covering element, such as a split or resawn wood shake 1, which preferably is tapered in thickness. Such shake includes a butt end 2, a tip end 3 and longitudinal sides 4 connecting the shake butt and tip ends. The sides 4 of the shake are stepped, providing transverse shoulders 5 facing the tip end of the shake and dividing the shake into a narrower tip portion 6 and a wider butt portion 7. The opposite sides of the shake tip and butt portions are parallel and each shoulder 5 extends substantially perpendicular to such sides, such that the side of each butt portion is offset from the corresponding side of the tip portion a distance equal to the depth of a shoulder. Preferably the two shoulders are of the same depth, which should be within the range of $\frac{1}{4}$ inch (0.64 cm) and $1\frac{1}{2}$ inches (3.8 cm), preferably being about $\frac{3}{4}$ inch (1.9 cm).

Figure 2:
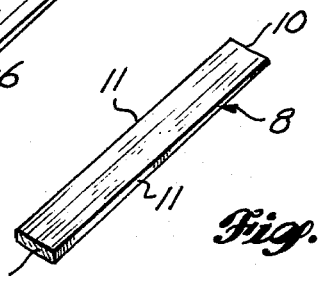

As shown in FIG. 2, the second component of a roof structure in accordance with the present invention is a generally rectangular plug or filler 8 which conveniently may be cut from a sawn wood shingle. Such plug has a butt end 9, a tip end 10 and parallel sides 11 connecting the butt and tip ends. The length of the plug is approximately the same as the length of the shake tip portion 6. The width of the plug is substantially greater, preferably about $\frac{1}{4}$ inch (0.64 cm) to $1\frac{1}{2}$ inches (3.8 cm) greater, than the combined depths of two shoulders 5. If the shoulders are $\frac{3}{4}$ inch (1.9 cm) deep, the plug should be about $1\frac{3}{4}$ inches (4.4 cm) to 3 inches (7.6 cm) wide, preferably about $2\frac{1}{4}$ inches (5.7 cm) wide. The thickness or height of the plug butt should be approximately the same as the thickness of a shake at its shoulders.

Figure 3:
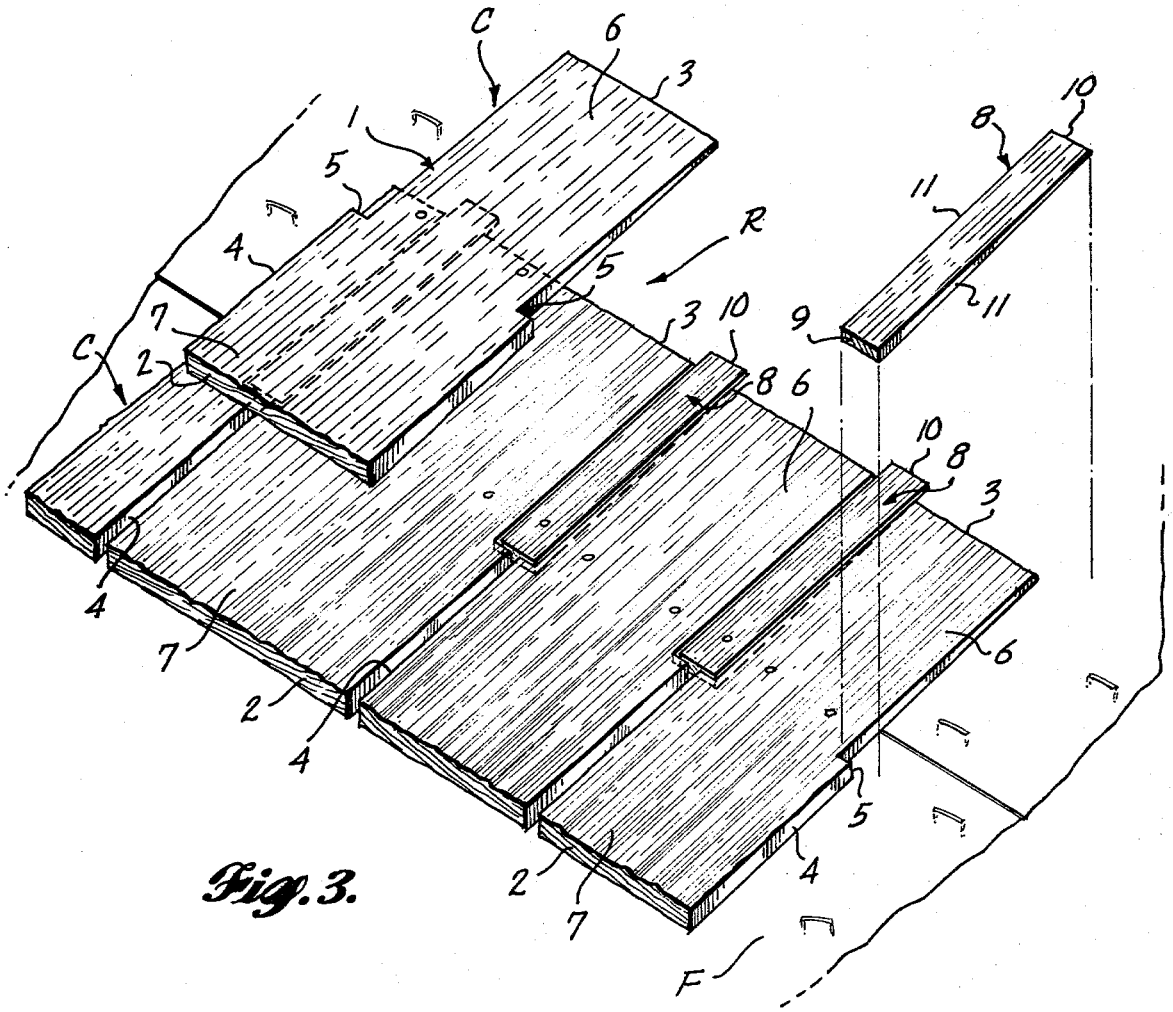
FIG. 3 is a somewhat diagrammatic top perspective of a portion of a roof structure in accordance with the present invention using the components of FIGS. 1 and 2, parts being shown in exploded relationship.
Figure 4:
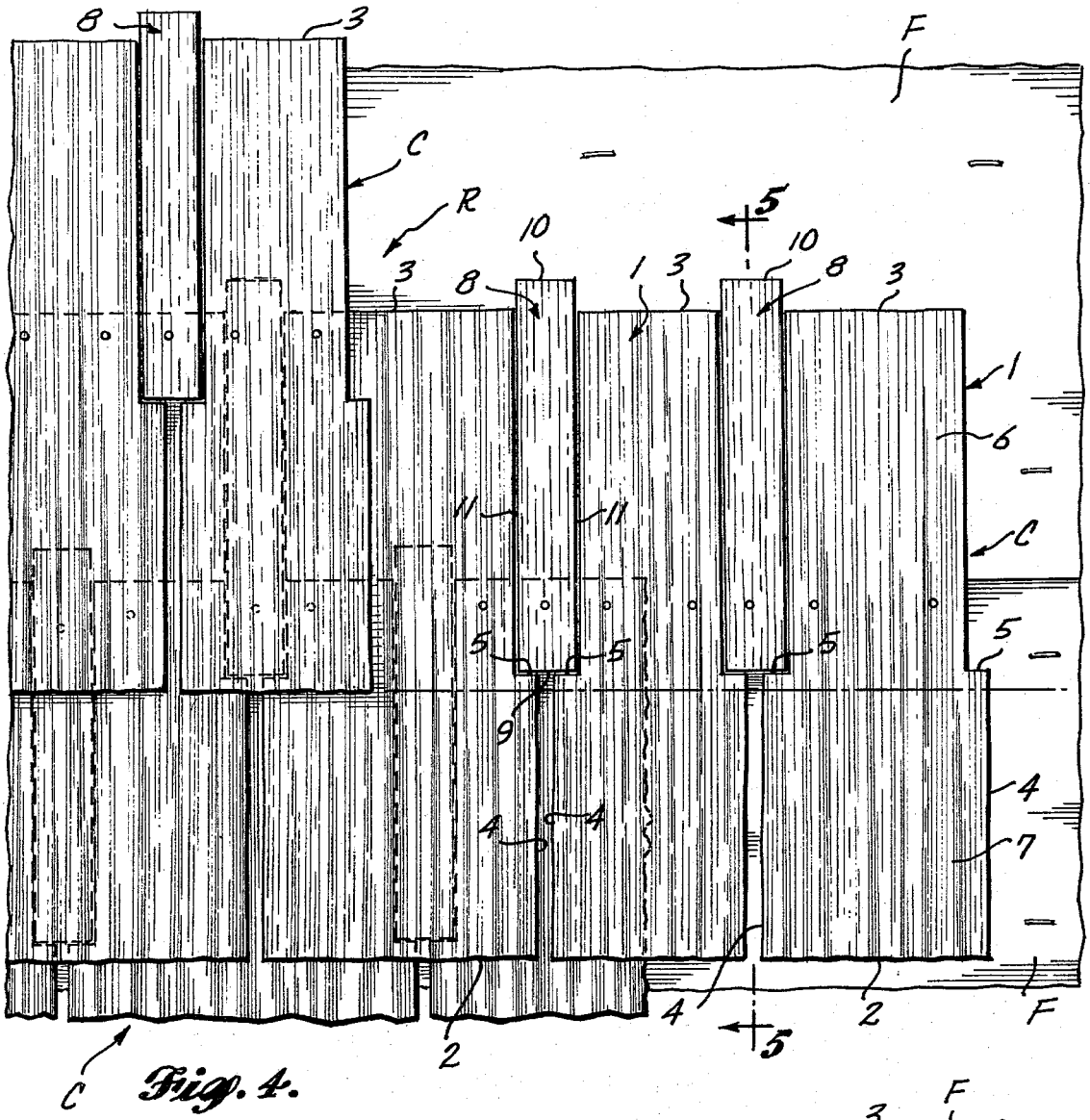
FIG. 4 is a top plan of a portion of a roof structure in accordance with the present invention using the components of FIGS. 1 and 2.
Figure 5:
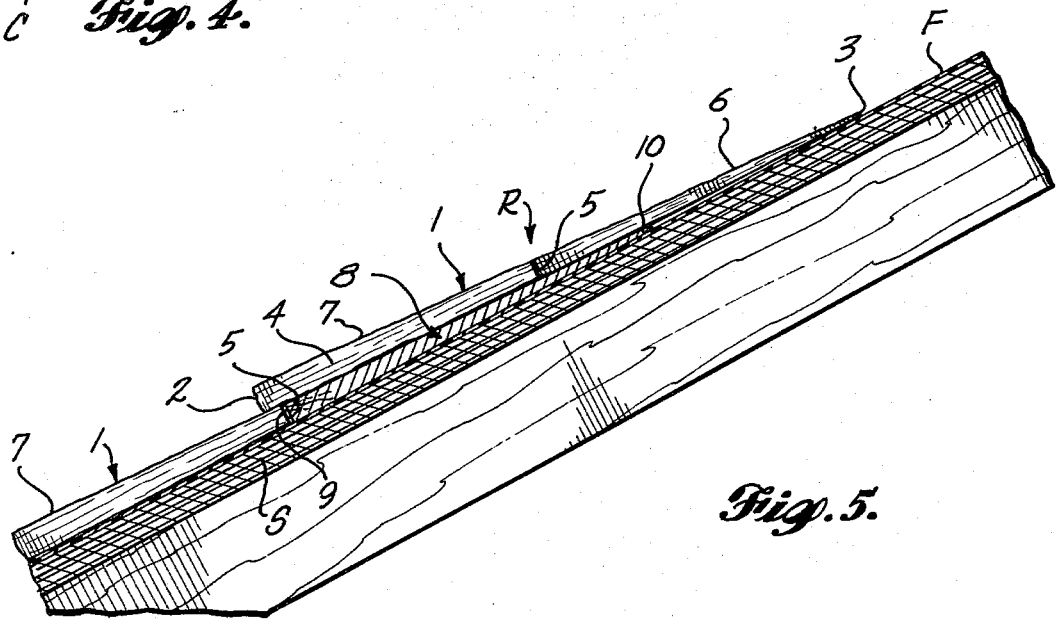
FIG. 5 is a section taken along line 5—5 of FIG. 4.

The components shown in FIGS. 1 and 2 are utilized in a roof structure R in the manner shown in FIGS. 3, 4 and 5. Such roof structure includes roof boards or sheathing S. Except in the starter course, a shake 1 is applied over the tip portions of shakes in the next lower course. The tip portion of such shake partially overlies the boards or sheathing. Next a filler 8 is applied with one of its sides 11 substantially in engagement with a sides of the shake tip portion 6 of the shake just applied and the butt 9 of the filler abutting a shake shoulder 5. Next, another shake is applied with a side of its tip portion substantially in engagement with the side 11 of the filler opposite the filler side adjacent to the first shake and a shoulder 5 of the second shake abutting the butt of the filler.

Since the width of the filler is substantially greater than the combined depths of the shoulders it engages, the adjacent sides of the butt portions 7 of the shakes are spaced apart at least to the extent that the width of the filler exceeds the combined depths of the shake shoulders. The shake butt portions should be spaced apart at least $\frac{1}{4}$ inch (0.64 cm). A pleasing rustic appearance, and a substantial saving of shake material, can be achieved with substantially greater spacing of the shake butt portions. In the preferred embodiment of the invention, the width of a filler exceeds the combined depths of two shoulders by about ¾ inch (1.9 cm) so that the shake butt portions are spaced apart about ¾ inch (1.9 cm).

The application method is continued to form a course C of alternating shakes and fillers with the butt ends 2 of the shakes substantially coplanar. Successive overlapping courses C then are applied with the spaces between shakes of each succeeding course out of registration with the spaces between the shakes of the preceding course.

The spacing of the shake shoulders from the shake butt end 2 is determined by the length of the shake butt portion it is desired to expose to the weather. Such shoulders should be overlapped approximately ½ inch (1.3 cm) by the shakes of the next succeeding course. In a representative installation, the shakes are 24 inches (61 cm) long with about 10 inches (25.4 cm) of the butt portion of each shake exposed to the weather. In such a representative installation, each shake shoulder is spaced about 10½ inches (26.7 cm) from the butt end of the shake.

The thickness or height of the butt ends 9 of the fillers 8 are substantially equal to the thickness of the shakes 1 at the shoulders 5 and the filler butts abut the shake shoulders tightly, so that such fillers form plugs between adjacent shakes at their shoulders. Also, the thickness of a filler throughout its length should be approximately equal to the corresponding thickness of the adjacent shake tip portions so that the bottom surfaces of the shakes of each course closely overlie the upper surfaces of the shakes of the next lower course.

The fillers prevent rain or snow from being blown up between the sides of shakes in the same course and between the upper surfaces of shakes in a lower course and the bottom surfaces of shakes in the next higher course, assuring that the completed roof structure is weathertight. In addition, in case of fire, the fillers or plugs act as fire stops deterring the passage of air between adjacent shakes so that the fire will spread less quickly than without such fillers or plugs. Further, as discussed above, the use of wide fillers spacing apart the adjacent edges of the butt portions of adjacent shakes provides a substantial saving in expensive shake material and gives a pleasing rustic appearance to the completed roof structure without reducing its weatherproof character.

I claim:

1. In a roof including generally rectangular individual covering elements having respective butt and tip ends and applied in generally coplanar, side adjacent relationship in each of several overlapping courses, the improvement comprising the adjacent sides of adjacent covering elements in a course having respective shoulders extending transversely of such sides, each shoulder dividing its covering element into respective tip and butt portions of unequal width, and a filler fitted between such adjacent sides and abutting said shoulders.

2. In the roof defined in claim 1, each shoulder extending substantially perpendicular to the shouldered side of its covering element.

3. In the roof defined in claim 1, each shoulder dividing its covering element into a narrower tip portion and a wider butt portion.

4. In the roof defined in claim 1 or 3, the shoulders being overlapped by the butt portions of covering elements of the next higher course.

5. In the roof defined in claim 3, the opposite sides of the covering element tip and butt portions being substantially parallel.

6. In the roof defined in claim 1, the shoulders having substantially the same depth.

7. In the roof defined in claim 1, the filler being of a width substantially greater than the combined depths of the two shoulders.

8. In the roof defined in claim 1, the filler being of a width equal to about three times the depth of one of the shoulders.

9. In the roof defined in claim 1, the covering elements being wood shakes each having a split upper surface and tapered in thickness toward its tip and the filler being a sawn wood shingle tapered in thickness toward its tip.

10. In the roof defined in claim 1 or 9, the thickness of the filler portion abutting the shoulders being substantially equal to the thickness of an adjacent covering element at its shoulder.

11. In a roof including generally rectangular individual covering elements having respective butt and tip ends and applied in generally coplanar, side adjacent relationship in each of several overlapping courses, the improvement comprising one side of one of the covering elements having a shoulder extending transversely of such side, said shoulder dividing such one covering element into respective butt and tip portions of unequal width, and a filler fitted between said shouldered side and the adjacent side of the adjacent covering element and abutting said shoulder.

12. The method of roofing which comprises applying to an inclined roof base structure a first generally rectangular covering element having a stepped longitudinal side forming a shoulder with such shoulder facing up the roof base incline, applying to the inclined roof base structure a generally rectangular filler with a side of such filler adjacent to the stepped side of such first building element and with an end of such filler abutting the shoulder of such first covering element, and applying to the roof base structure a second generally rectangular covering element having a stepped longitudinal side forming a shoulder with such stepped side of such second element adjacent to the side of the filler opposite the side adjacent to the first covering element and the shoulder of such second covering element abutted by the end of such filler abutting the shoulder of the first covering element.

13. The method of roofing which comprises applying to an inclined roof base structure a first generally rectangular covering element having a stepped longitudinal side forming a shoulder with such shoulder facing up the roof base incline, applying to the inclined roof base structure a generally rectangular filler with a side of such filler adjacent to the stepped side of such first covering element and with the lower end of such filler abutting the shoulder of such first covering element, and applying to the roof base structure a second generally rectangular covering element with a longitudinal side of such second element adjacent to the side of the filler opposite the side adjacent to the first covering element.

14. In a roof including generally rectangular individual covering elements having respective butt and tip ends and applied in generally coplanar, side adjacent relationship in each of several overlapping courses, the improvement comprising the adjacent sides of adjacent covering elements in a course having respective shoulders extending transversely of such sides, each shoulder dividing its covering element into respective tip and butt end portions of unequal width such that such adjacent covering elements have corresponding narrower end portions with opposing sides, and a filler having a portion fitted between such adjacent covering elements, said filler portion having opposite sides in substantially contiguous engagement, respectively, with the opposing sides of the narrower end portions of such adjacent covering elements.

15. In the roof defined in claim 14, the covering elements being wood shakes each having a split upper surface and tapered in thickness toward its tip and the filler being a sawn wood shingle tapered in thickness toward its tip.

16. In the roof defined in claim 14 or 15, the filler having an end abutting the shoulders of the adjacent covering elements.

* * * * *